US011164712B2

(12) United States Patent
Pan et al.

(10) Patent No.: US 11,164,712 B2
(45) Date of Patent: Nov. 2, 2021

(54) FIXING AND UNLOCKING MECHANISM FOR PLUG-IN TYPE CIRCUIT BREAKER

(71) Applicant: Shanghai Liangxin Electrical Co., Ltd, Shanghai (CN)

(72) Inventors: Wanjun Pan, Shanghai (CN); Yanqun Yang, Shanghai (CN)

(73) Assignee: Shanghai Liangxin Electrical Co., LTD, Shanghai (CN)

( * ) Notice: Subject to any disclaimer, the term of this patent is extended or adjusted under 35 U.S.C. 154(b) by 0 days.

(21) Appl. No.: 16/757,626

(22) PCT Filed: Oct. 17, 2018

(86) PCT No.: PCT/CN2018/110715
§ 371 (c)(1),
(2) Date: Apr. 20, 2020

(87) PCT Pub. No.: WO2019/080761
PCT Pub. Date: May 2, 2019

(65) Prior Publication Data

US 2020/0343068 A1 Oct. 29, 2020

(30) Foreign Application Priority Data

Oct. 26, 2017 (CN) ..... 201711022048.2

(51) Int. Cl.
*H01H 71/02* (2006.01)

(52) U.S. Cl.
CPC ... *H01H 71/0264* (2013.01); *H01H 2223/028* (2013.01)

(58) Field of Classification Search
CPC .... H01H 71/0264; H01H 71/58; H01H 71/10; H01H 71/12; H01H 2223/028
See application file for complete search history.

(56) References Cited

U.S. PATENT DOCUMENTS 4,587,391 A * 5/1986 Harper ..... H02B 1/048 200/296
9,299,522 B2 * 3/2016 Sudhakar ..... H02B 11/127

FOREIGN PATENT DOCUMENTS

CN 202210497 5/2012
CN 102820163 12/2012
(Continued)

OTHER PUBLICATIONS

International Search Report and Written Opinion issued in International Application No. PCT/CN2019/086704 dated Aug. 8, 2019.
(Continued)

*Primary Examiner* — Vanessa Girardi
(74) *Attorney, Agent, or Firm* — Hogan Lovells US LLP

(57) ABSTRACT

A fixing and unlocking mechanism for a plug-in type circuit breaker includes a housing (1) A button (2) is mounted in a button slot (101) of the housing (1). The fixing and unlocking mechanism is characterized in that the housing (1) is provided with a locking mechanism (3) therein, so that the plug-in type circuit breaker cannot be unplugged from a mounting cabinet, and the housing (1) is further provided with an unlocking mechanism (4) therein, which can unlock the locking mechanism (3) to make the plug-in type circuit breaker is unplugged from the mounting cabinet.

7 Claims, 5 Drawing Sheets

(56) References Cited

FOREIGN PATENT DOCUMENTS

| | | |
|---|---|---|
| CN | 106340429 | 1/2017 |
| CN | 107833799 | 3/2018 |

OTHER PUBLICATIONS

International Search Report dated Dec. 21, 2018 issued in application serial No. PCT/CN2018/110715.
English Translation of Chinese Abstracts.

* cited by examiner

FIXING AND UNLOCKING MECHANISM FOR PLUG-IN TYPE CIRCUIT BREAKER

TECHNICAL FIELD

The present disclosure pertains to the technical field of circuit breakers, and in particular relates to a fixing and unlocking mechanism for a plug-in type circuit breaker.

BACKGROUND ART

Circuit breakers are divided into high-voltage circuit breakers and low-voltage circuit breakers according to their scopes of use. The low-voltage circuit breaker is also referred to as an automatic switch, which is an electrical appliance that acts as a manual switch and can also automatically perform voltage-loss, under-voltage, overload, or short-circuit protection. It can be used for distribution of electrical energy, infrequent starting of an asynchronous motor, and protection of power circuit, motor, and the like. Circuits can be automatically cut off when they have severe failures such as overload or short-circuit and under-voltage failures. The circuit breaker functions equivalently to a combination of fuse switch and over-heat or under-heat relay or the like, and it is generally unnecessary to change parts or components after the failure current is interrupted, therefore the circuit breakers have been widely used.

Circuit breakers are divided into a plug-in type, a fixed type, and a drawer type according to installation modes. The plug-in type circuit breakers can be used for effectively improving the safety in the industries where electrical equipment is used. As the plug-in type circuit breakers are widely used in various electrical equipment, the plug-in type circuit breakers have been developed to have various structures in order to meet the requirements for installation in various different electrical equipment. In the arrangements of the currently existing traditional plug-in type circuit breaker products at installation positions, in general, a plug-in type circuit breaker is locked in a cabinet by using a spring piece. If it is necessary to unlock and remove the circuit breaker from the cabinet, an operation is inconveniently performed with the aid of an external force or an additional tool. Moreover, the plug-in type circuit breaker is removed regardless of an ON or OFF state of the circuit breaker. When the circuit breaker is removed in a closed state, a safety accident is likely to occur.

SUMMARY

In view of the above-mentioned technical deficiencies of the prior plug-in type circuit breakers which need to be locked by external devices during installation, resulting in inconvenient operation and easy occurrence of safety accidents, an object of the present disclosure is to provide a fixing and unlocking mechanism for a plug-in type circuit breaker. Fixing and unlocking mechanism is additionally provided in the circuit breaker, so that the circuit breaker is smoothly and stably installed in a cabinet. After the circuit breaker is disconnected, the circuit breaker can be unlocked from the cabinet by pulling a button outward, and the circuit breaker can be easily removed from the cabinet by continuously pulling the button. In this way, the safety performance of the circuit breaker in use is improved.

Technical Solution

In order to achieve the above technical objective, a fixing and unlocking mechanism for a plug-in type circuit breaker is designed in the present disclosure, which comprises a housing, a button mounted in a button slot of the housing, wherein the housing is provided therein with a locking mechanism so that the plug-in type circuit breaker cannot be unplugged from an installation cabinet, and the housing is further provided therein with an unlocking mechanism, which can unlock the locking mechanism so that the plug-in type circuit breaker is unplugged from the installation cabinet.

Further, the locking mechanism includes an fastener, a cylinder is provided at a right end of the fastener, the cylinder is mounted in an arcuate groove on an inner wall of the housing, a first torsion spring is mounted to the housing, the first torsion spring has one end resting on a lower surface of the fastener, a first locking boss is provided on an upper surface of the fastener, and the housing is provided with a first limiting slot hole corresponding to the first locking boss.

Further, the unlocking mechanism includes an unbuckling member, the unbuckling member is mounted to the inner wall of the housing via a first shaft and is rotatable about the first shaft, a first unbuckling boss is provided at a right end of the unbuckling member, the first unbuckling boss is snapped on a unbuckling linkage step at a left end of the fastener, a first unbuckling block is provided at a left end of the unbuckling member, and the first unbuckling block corresponds to a first driving protrusion on the button.

Further, the locking mechanism and the unlocking mechanism are formed integrally, including a locking and unbuckling member, the locking and unbuckling member is mounted to an inner wall of the housing via a second shaft and is rotatable about the second shaft, a second locking boss is provided at a right upper end of the locking and unbuckling member, the housing is provided with a second limiting slot hole corresponding to the second locking boss, a second torsion spring is mounted to the housing, the second torsion spring has one end resting on a lower surface of the locking and unbuckling member on a right side of the second shaft, a second unbuckling block is provided at a left end of the locking and unbuckling member, and the second unbuckling block corresponds to a second driving protrusion on the button.

Further, the first locking boss is chamfered at its right side surface.

Further, the second locking boss is chamfered at its right side surface.

Further, the first torsion spring rests on a first stepped surface of a lower portion of the fastener.

Further, the second torsion spring rests on a second stepped surface of a lower portion of the locking and unbuckling member.

Further, a limiting block is provided on a lower end surface of the locking and unbuckling member.

Advantageous Effect

In a fixing and unlocking mechanism for a plug-in type circuit breaker according to the present disclosure, fixing and unlocking mechanism is additionally provided in the circuit breaker, so that the circuit breaker is smoothly and stably installed in a cabinet, and the circuit breaker cannot be removed from the cabinet via the housing, wires, and other parts. After the circuit breaker is disconnected, the circuit breaker can be unlocked from the cabinet by pulling a button outward, and the circuit breaker can be easily removed from the cabinet by continuously pulling the button. In this way, the safety performance of the circuit breaker in use is improved.

DETAILED DESCRIPTION OF EMBODIMENTS

Figure 1:
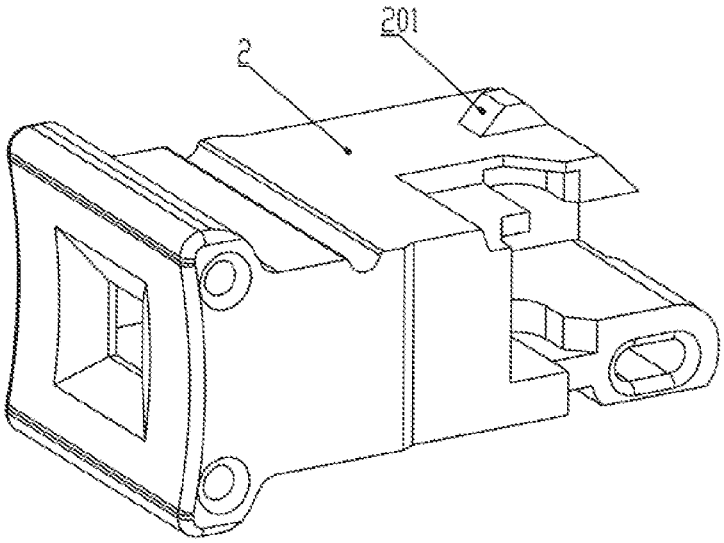
FIG. 1 is a schematic structural view of a button of a first embodiment of the present disclosure.

The present disclosure is further described below with reference to the accompanying drawings and embodiments.

A fixing and unlocking mechanism for a plug-in type circuit breaker comprises a housing 1, a button 2 mounted in a button slot 101 of the housing 1. The housing 1 is provided therein with a locking mechanism 3 so that the plug-in type circuit breaker cannot be unplugged from an installation cabinet, and the housing 1 is further provided therein with an unlocking mechanism 4, which can unlock the locking mechanism 3 so that the plug-in type circuit breaker is unplugged from the installation cabinet.

First Embodiment

Figure 2:
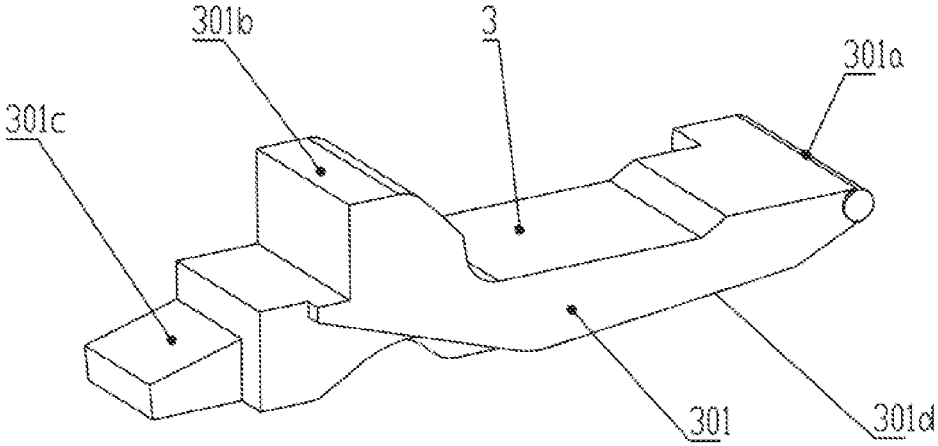
FIG. 2 is a schematic structural view of a fastener in the first embodiment of the present disclosure.
Figure 3:
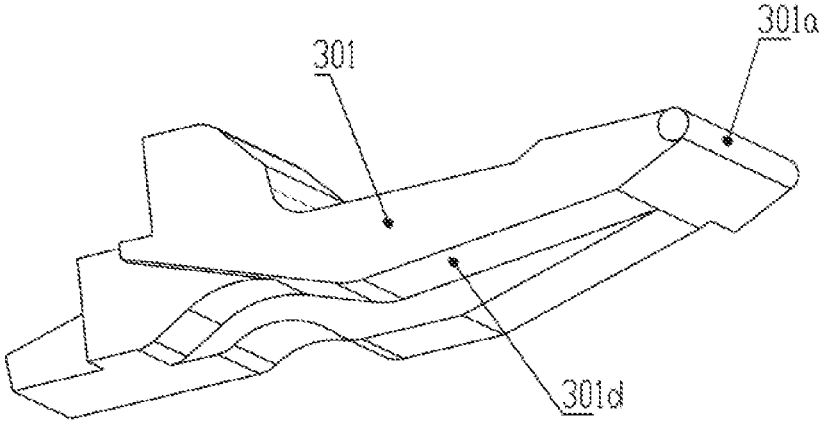
FIG. 3 is a schematic structural view showing the position of a first stepped surface in the first embodiment of the present disclosure.
Figure 5:
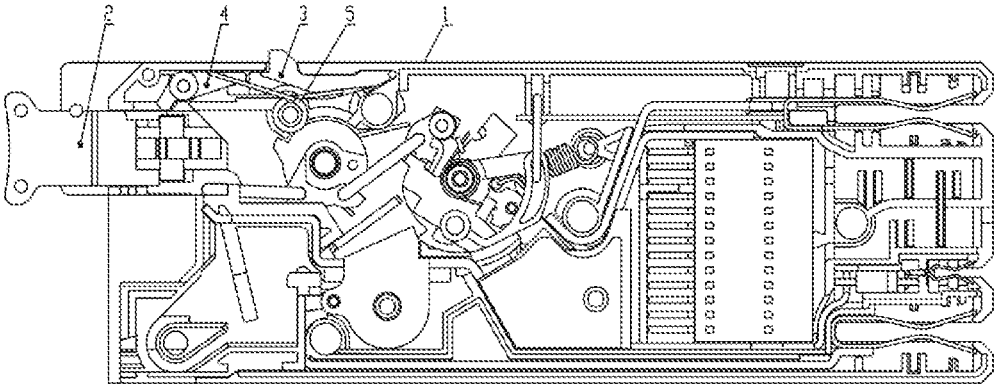
FIG. 5 is a schematic structural view showing mounting of a torsion spring in the first embodiment of the present disclosure.

In a specific embodiment according to the present disclosure, as shown in FIGS. 2 and 3, the locking mechanism 3 includes a fastener 301, a cylinder 301*a* is provided at a right end of the fastener 301, and the cylinder 301*a* is mounted in an arcuate groove 102 on an inner wall of the housing 1. As shown in FIG. 5, a first torsion spring 5 is mounted to the housing 1, and the first torsion spring 5 has one end resting on the housing 1, and the other end resting on a lower surface of the fastener 301. In this embodiment, the first torsion spring 5 rests on a first stepped surface 301*d* of a lower portion of the fastener 301. A first locking boss 301*b* is provided on an upper surface of the fastener 301, and the first locking boss 301*b* is chamfered at its right side surface. The housing 1 is provided with a first limiting slot hole 103 corresponding to the first locking boss 301*b*.

Figure 4:
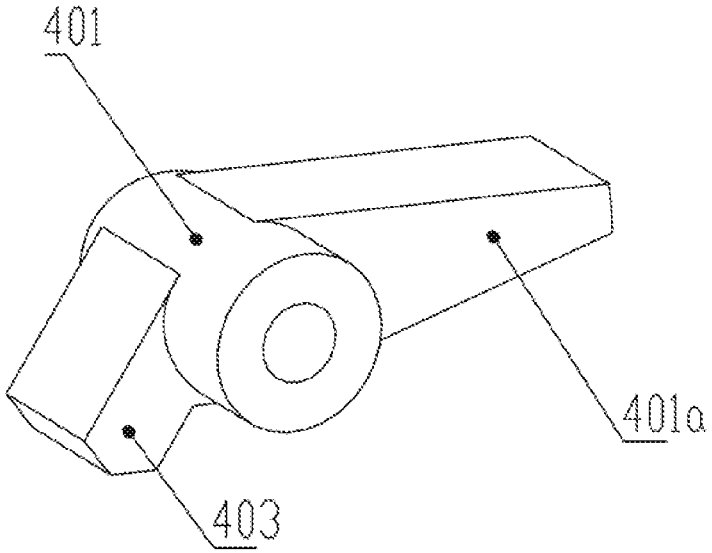
FIG. 4 is a schematic structural view of an unbuckling member in the first embodiment of the present disclosure.

As shown in FIG. 4, the unlocking mechanism 4 includes a unbuckling member 401, the unbuckling member 401 is mounted to the inner wall of the housing 1 via a first shaft 402 and is rotatable about the first shaft 402, a first unbuckling boss 401*a* is provided at a right end of the unbuckling member 401, the first unbuckling boss 401*a* is snapped on a unbuckling linkage step 301*c* at a left end of the fastener 301, a first unbuckling block 403 is provided at a left end of the unbuckling member 401, and the first unbuckling block 403 corresponds to a first driving protrusion 201 on the button 2 as shown FIG. 1.

Figure 6:
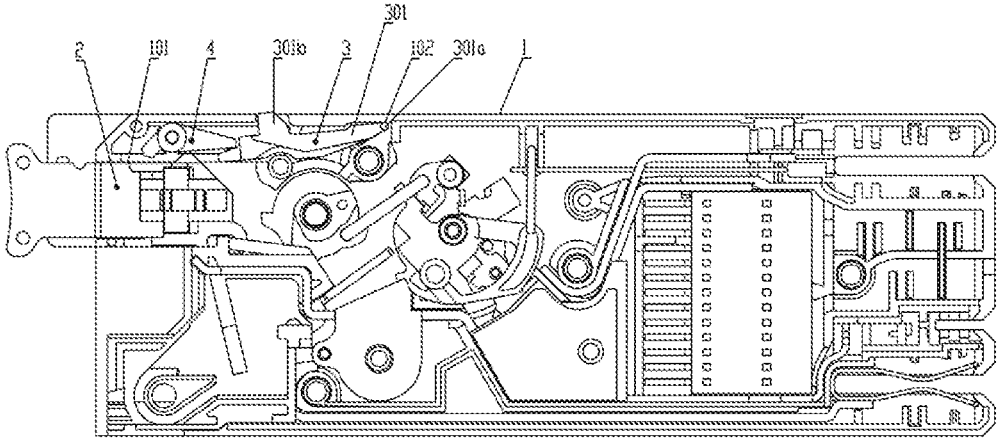
FIG. 6 is a schematic structural view of a circuit breaker plugged into a cabinet with a fastener depressed into a housing in the first embodiment of the present disclosure.
Figure 7:
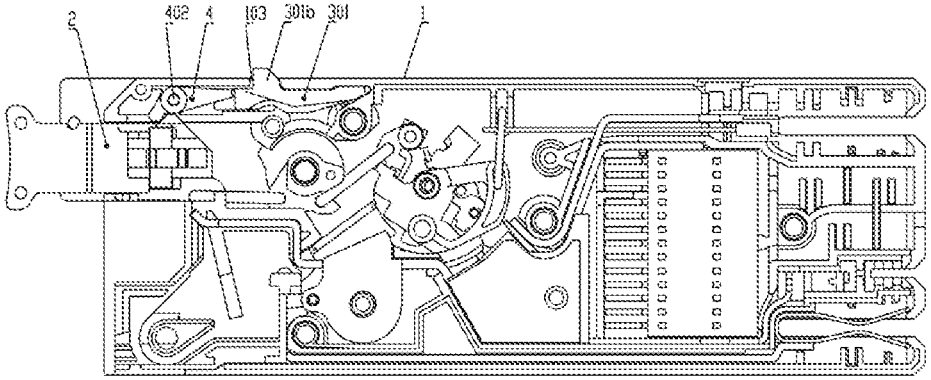
FIG. 7 is a schematic structural view of the circuit breaker stably installed in the cabinet in the first embodiment of the present disclosure.

As shown in FIG. 6, during installation of the circuit breaker in a cabinet, the first locking boss 301*b* of the fastener 301 is depressed by the cabinet, the fastener 301 is rotated counterclockwise about the cylinder 301*a* on its right side against the first torsion spring 5, and thus the circuit breaker can be smoothly installed in the cabinet. As shown in FIG. 7, the circuit breaker is stably installed in the cabinet, the cabinet no longer presses the first locking boss 301*b* of the fastener 301, the fastener 301 is rotated clockwise and restored to its initial position under the action of the first torsion spring 5, the first locking boss 301*b* protrudes beyond the housing 1 from the first limiting slot hole 103, and thus the circuit breaker is locked in the cabinet by the first locking boss 301*b* and cannot be unplugged therefrom. The circuit breaker can be switched on by pressing the button 2, the circuit breaker can be opened by pulling out the button 2, and the circuit breaker cannot be removed from the cabinet via a part of the circuit breaker other than the button 2.

Figure 8:
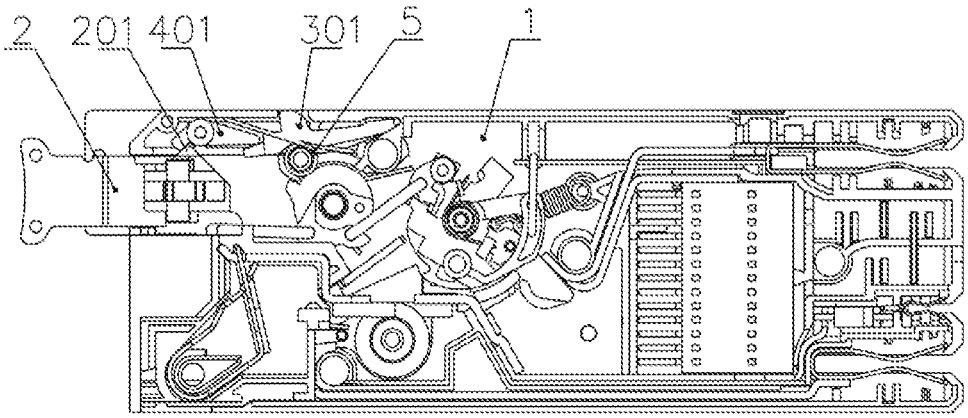
FIG. 8 is a schematic structural view of the circuit breaker unplugged from the cabinet in the first embodiment of the present disclosure.

As shown in FIG. 8, after the button 2 is pulled to a certain position, if the button 2 is continuously pulled, the first driving protrusion 201 on the right upper portion of the button 2 acts on the first unbuckling block 403 at the left end of the unbuckling member 401, the unbuckling member 401 is rotated clockwise about the first shaft 402, the unbuckling linkage step 301*c* of the fastener 301 is subjected to the action of the first unbuckling boss 401*a* at the right end of the unbuckling member 401, the fastener 301 is rotated counterclockwise about the cylinder 301*a* on its right side against the reacting force from the first torsion spring 5, the first locking boss 301*b* is moved downward to a certain position and lower than the surface of the housing 1 of the circuit breaker, and thus the circuit breaker is unlocked from the cabinet and can be easily unplugged from the cabinet.

Second Embodiment

Figure 9:
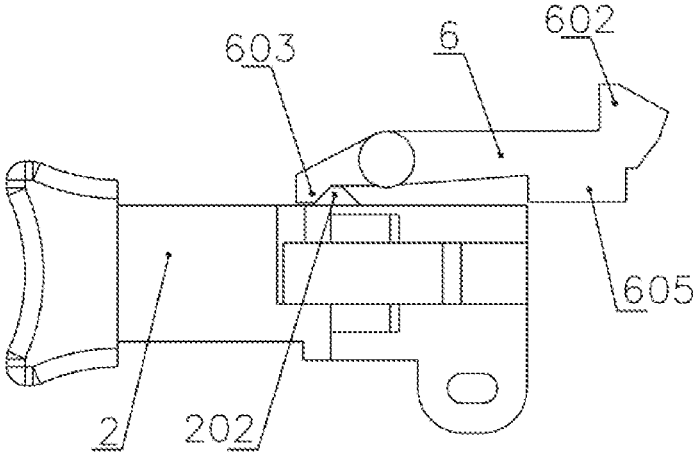
FIG. 9 is a schematic structural view of a circuit breaker plugged into a cabinet in a second embodiment of the present disclosure.
Figure 10:
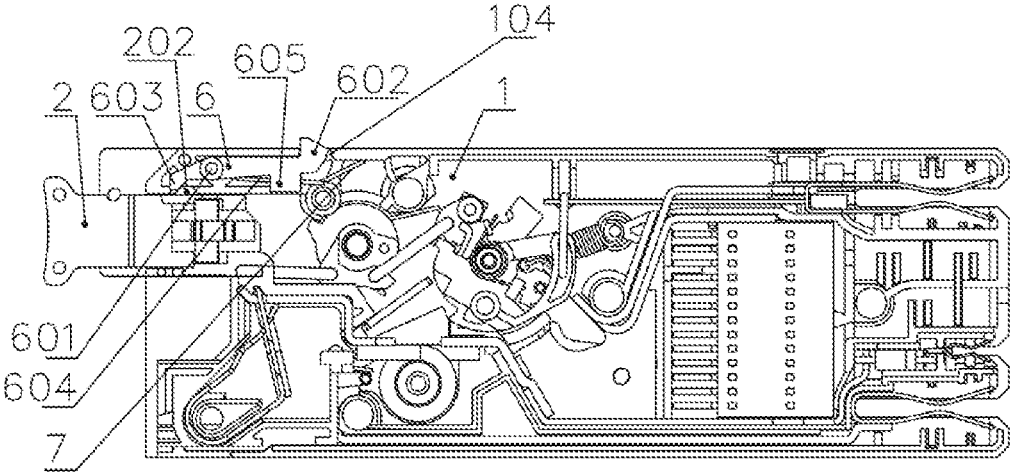
FIG. 10 is a schematic structural view of the circuit breaker stably installed in the cabinet when it is disconnected in the second embodiment of the present disclosure.

In another specific embodiment of the present disclosure, as shown in FIGS. 9 and 10, the locking mechanism 3 and the unlocking mechanism 4 are formed integrally, including a locking and unbuckling member 6, the locking and unbuckling member 6 is mounted to an inner wall of the housing 1 via a second shaft 601 and is rotatable about the second shaft 601, a second locking boss 602 is provided at a right upper end of the locking and unbuckling member 6, and the second locking boss 602 is chamfered at its right side surface. The housing 1 is provided with a second limiting slot hole 104 corresponding to the second locking boss 602, a second torsion spring 7 is mounted to the housing 1, and the second torsion spring 7 has one end resting on the housing 1, and the other end resting on a lower surface of the locking and unbuckling member 6 on a right side of the second shaft 601. In this embodiment, the second torsion spring 7 rests on a second stepped surface 604 of a lower portion of the locking and unbuckling member 6. A second unbuckling block 603 is provided at a left end of the locking and unbuckling member 6, and the second unbuckling block 603 corresponds to a second driving protrusion 202 on the button 2. A limiting block 605 is provided on a lower end surface of the locking and unbuckling member 6.

When the circuit breaker is in a disconnected state, during plugging of the circuit breaker into a cabinet, the second locking boss 602 on the right side of the locking and unbuckling member 6 is depressed by the cabinet, the locking and unbuckling member 6 is rotated clockwise against a reacting force from the second torsion spring 7, and thus the circuit breaker can be smoothly installed in the cabinet. After the circuit breaker is installed in the cabinet, the second locking boss 602 is no longer pressed by the cabinet, thus the locking and unbuckling member 6 is rotated counterclockwise under the action of the second torsion spring 7, the second locking boss 602 protrudes from the upper portion of the housing, and therefore the circuit breaker is locked in the cabinet by the second locking boss 602 and cannot be unplugged therefrom. The circuit breaker can be switched on by pressing the button 2, the circuit breaker can be opened by pulling out the button 2. After the button 2 is pulled outward to a certain position, the second driving protrusion 202 on the right upper portion of the button 2 acts on the second unbuckling block 603 on the left side of the locking and unbuckling member 6, the locking and unbuckling member 6 is rotated clockwise about the second shaft 601 against the reacting force from the second torsion spring 7 under the action of the button 2, the second locking boss 602 is moved downward to a certain position and lower than the surface of the housing of the circuit breaker, and thus the circuit breaker is unlocked from the cabinet and can be easily unplugged from the cabinet.

Figure 11:
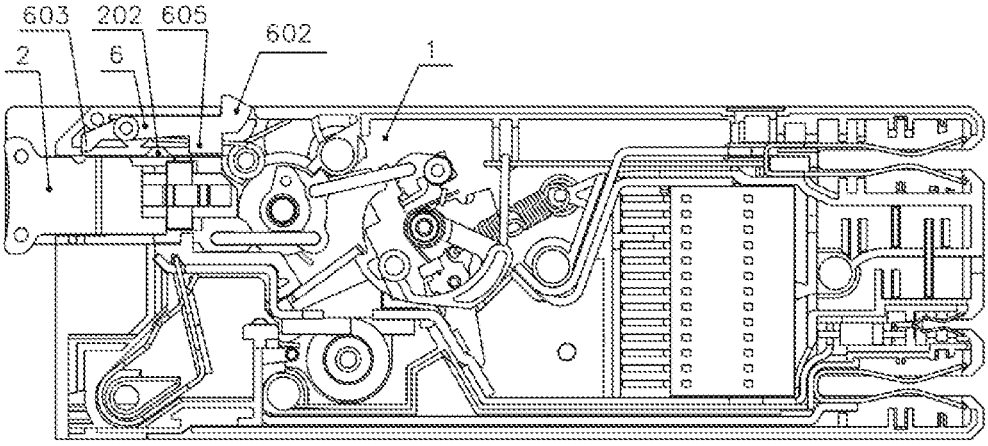
FIG. 11 is a schematic structural view of the circuit breaker stably installed in the cabinet when it is closed in the second embodiment of the present disclosure.

When the circuit breaker is in a closed state, the limiting block 605 provided on the right lower end surface of the locking and unbuckling member 6 abuts against the button 2, so that the second locking boss 602 cannot be moved downward, and the circuit breaker cannot be plugged into the cabinet. As shown in FIG. 11, when the circuit breaker is in the cabinet, if the circuit breaker is pulled via a part other than the button 2, the second locking boss 602 at the right upper end of the locking and unbuckling member 6 is subjected to pressure from the cabinet, and the locking and unbuckling member 6 is rotated clockwise. Since the limiting block 605 is provided on the lower portion of the locking and unbuckling member 6, the limiting block 605 abuts against the button 2, so that the second locking boss 602 cannot be moved downward, and therefore the circuit breaker cannot be removed from the cabinet.

The structures, proportions, sizes, quantities, and the like depicted in the drawings appended to the embodiments are only used to cooperate the contents disclosed in the specification, to facilitate understanding and reading by those skilled in the art, and are not intended to limit restrictive conditions where the present disclosure is implementable, and therefore do not have a technically essential meaning. Any modification in structure, change in proportion relationship, or adjustment in size, without affecting the efficacy that can be generated by the present disclosure and the object that can be achieved by the present disclosure, should fall within the scope that can be covered by the technical content disclosed in the present disclosure. Moreover, terms such as "upper", "lower", "left", "right", "middle", "clockwise", "counterclockwise", and the like cited in this specification are also only intended to facilitate clear description, but are not intended to limit the scope where the present disclosure is implementable, and a change or adjustment in a relative relationship thereof, without essentially changing the technical content, should also be considered as falling within the scope where the present disclosure is implementable.

What is claimed is:

1. A fixing and unlocking mechanism for a plug-in type circuit breaker, comprising a housing, and a button mounted in a button slot of the housing, wherein the housing is provided therein with a locking mechanism, wherein the locking mechanism prevents the plug-in type circuit breaker from being unplugged from an installation cabinet, and the housing is further provided therein with an unlocking mechanism, wherein the unlocking mechanism is capable of unlocking the locking mechanism so that the plug-in type circuit breaker is unplugged from the installation cabinet, wherein the unlocking mechanism comprises a unbuckling member, wherein the unbuckling member is mounted in the housing via a first shaft and is rotatable about the first shaft, a first unbuckling boss is provided at one end of the unbuckling member, the first unbuckling boss is snapped on a unbuckling linkage step at an end of the fastener, a first unbuckling block is provided at the other end of the unbuckling member, and the first unbuckling block corresponds to a first driving protrusion on the button; or wherein the locking mechanism and the unlocking mechanism are formed integrally, comprising a locking and unbuckling member, the locking and unbuckling member is mounted in the housing via a second shaft and is rotatable about the second shaft, a second locking boss is provided at an upper end on one side of the locking and unbuckling member, the housing is provided with a second limiting slot hole corresponding to the second locking boss, a second torsion spring is mounted to the housing, the second torsion spring has one end resting on a lower surface of the locking and unbuckling member on a right side of the second shaft, a second unbuckling block is provided at the other end of the locking and unbuckling member, and the second unbuckling block corresponds to a second driving protrusion on the button.

2. The fixing and unlocking mechanism for a plug-in type circuit breaker according to claim 1, wherein the second locking boss is chamfered.

3. The fixing and unlocking mechanism for a plug-in type circuit breaker according to claim 1, wherein the second torsion spring rests on a second stepped surface of a lower portion of the locking and unbuckling member.

4. The fixing and unlocking mechanism for a plug-in type circuit breaker according to claim 1, wherein a limiting block is provided on a lower end surface of the locking and unbuckling member.

5. The fixing and unlocking mechanism for a plug-in type circuit breaker according to claim 1, wherein the locking mechanism comprises a fastener, a cylinder is provided at a right end of the fastener, the cylinder is mounted in an arcuate groove on an inner wall of the housing, a first torsion spring is mounted to the housing, the first torsion spring has one end resting on a lower surface of the fastener, a first locking boss is provided on an upper surface of the fastener, and the housing is provided with a first limiting slot hole corresponding to the first locking boss.

6. The fixing and unlocking mechanism for a plug-in type circuit breaker according to claim 5, wherein the first locking boss is chamfered.

7. The fixing and unlocking mechanism for a plug-in type circuit breaker according to claim 5, wherein the first torsion spring rests on a first stepped surface of a lower portion of the fastener.

* * * * *